US007992635B2

(12) United States Patent
Cherewyk

(10) Patent No.: US 7,992,635 B2
(45) Date of Patent: Aug. 9, 2011

(54) SYSTEM AND APPARATUS FOR SEALING A FRACTURING HEAD TO A WELLHEAD

(75) Inventor: Boris (Bruce) P. Cherewyk, Calgary (CA)

(73) Assignee: Isolation Equipment Services Inc., Calgary (CA)

( * ) Notice: Subject to any disclaimer, the term of this patent is extended or adjusted under 35 U.S.C. 154(b) by 148 days.

(21) Appl. No.: 11/835,948

(22) Filed: Aug. 8, 2007

(65) Prior Publication Data

US 2008/0035326 A1 Feb. 14, 2008

Related U.S. Application Data

(60) Provisional application No. 60/821,769, filed on Aug. 8, 2006, provisional application No. 60/895,199, filed on Mar. 16, 2007.

(51) Int. Cl.
*E21B 33/03* (2006.01)

(52) U.S. Cl. ..... 166/90.1; 166/75.15

(58) Field of Classification Search ..... 166/90.1, 166/75.15, 75.13, 75.11
See application file for complete search history.

(56) References Cited

U.S. PATENT DOCUMENTS

| | | | | |
|---|---|---|---|---|
| 4,390,063 | A * | 6/1983 | Wells, Jr. | 166/84.5 |
| 5,012,865 | A | 5/1991 | McLeod | |
| 6,318,729 | B1 * | 11/2001 | Pitts et al. | 277/511 |
| 6,446,664 | B1 | 9/2002 | Parsons | |
| 6,557,629 | B2 | 5/2003 | Wong et al. | |
| 6,899,172 | B2 | 5/2005 | McLeod et al. | |
| 7,159,663 | B2 * | 1/2007 | McGuire et al. | 166/379 |
| 7,213,641 | B2 | 5/2007 | McGuire et al. | |

FOREIGN PATENT DOCUMENTS

CA 2486513 7/2008

* cited by examiner

*Primary Examiner* — David J Bagnell
*Assistant Examiner* — Brad Harcourt
(74) *Attorney, Agent, or Firm* — Sean W Goodwin

(57) ABSTRACT

A wear-resistant sealing system for introducing fracturing fluids to a wellhead comprising a tubular connector having a retaining shoulder and bridging a flange interface created between a frachead and a lower tubular structure. The tubular connector has upper and lower sealing elements above and below the flange interface and forms a contiguous bore for fluid communication of the fracturing fluids from the frac-head to the lower tubular structure and wellhead.

37 Claims, 8 Drawing Sheets

SYSTEM AND APPARATUS FOR SEALING A FRACTURING HEAD TO A WELLHEAD

FIELD OF THE INVENTION

The invention relates to improvements to a frachead and a wellhead for a well. More particularly, an improved sealing system including a wear sleeve connection positioned to bridge and seal a flange interface between the frachead and the wellhead.

BACKGROUND OF THE INVENTION

In the field of oil well servicing, the practice of fracturing a subterranean formation accessed by a wellbore is standard procedure. During this fracturing procedure, large amounts of abrasive fluid-solids mixtures of fracturing fluids are pumped down the wellbore to the formation by high pressure pumps. A fracturing block or frachead, capable of withstanding high pressures and resistant to erosion, is attached to a wellhead or other tubular structures fixtures located on a wellhead, and fluid lines from high pressure pumps are attached to the frachead. The frachead directs the fracturing fluid through the wellhead and down the wellbore. The interior bore of the frachead is subjected to extreme erosion from the abrasive fluid-solids mixtures. When erosion of the frachead reaches a certain point, the frachead no longer safely has the strength required to contain the pressure of the fracturing fluids and must be taken out of service and repaired if possible. Repairs by welding are time consuming and can introduce metallurgical problems, such as hardening, cracking and stress relieving, due to the welding procedure. Alternatively, it is known to fit a frachead with a replaceable abrasion resistant wear sleeve and thus minimize abrasive wear on the pressure retaining walls of the frachead. The wear resistant frachead body is coupled through a flanged connection to a lower tubular structure which may be the wellhead itself or an intermediate sub or spool structure. Both the frachead and lower tubular structure can be fit with wear sleeves.

Conventional flanged connections have a ring seal which comprises a corresponding and a circumferentially extending groove on the flange of the frachead body and a circumferentially extending groove on the flange of the spool structure. A deformable ring seal or ring gasket is sandwiched and sealably crushed between the flanges when coupled. The ring gasket is typically expected to seal on its first use, and may only successfully be reused once or twice more. The circumferentially extending grooves for the gasket seals can also deform after repeated installations of new gasket seals, and must eventually be repaired. Such deficiencies in the grooves are usually not apparent and are not noticed until the failure of the seals.

Furthermore, the radial spacing between the bore, the circumferentially extending grooves and the bolts circle of the flange are set by API (American Petroleum Institute) standards and thereby constrain the maximum bore that can extend concentrically therethrough, limiting the maximum size of any wear sleeves. Accordingly, retrofit or provision of a lower tubular member with a wear sleeve results in a smaller wear sleeve bore.

There is a need for an improved system for wear sleeves for frac head installations which maximizes the flow bore and obviates the limitations of the existing ring seals.

SUMMARY OF THE INVENTION

A frac block, such as a frachead, is used to accommodate a multi-line hook up to enable maximum pumping rates of pressurized fracturing fluids during a well fracturing stimulation process. A wear sleeve is inserted in the frachead to protect the main body from the highly abrasive fluids. The main body of the frachead is fluidly secured to a lower tubular body in fluid communication with the wellhead. The lower tubular body can be a modified wellhead itself or conveniently a specialized sub, such as a spool inserted therebetween. The wear sleeve comprises a cylindrical sleeve, such as a tubular connector, which is mounted or installed concentrically, in fluid communication with the bore of the frachead, and sealing elements which provide high pressure seals. The tubular connector extends between the frachead and the lower tubular structure, bridging the flange interface created between the frachead and the lower tubular structure.

The tubular connector, having two functions, forms both a wear sleeve to protect the frachead and a seal across the flange interface. The formation of this sealing area negates the requirement for the API ring gasket noted above.

In a first embodiment, a tubular connector is assembled from two tubular components, an inner tubular wear sleeve and an outer tubular sealing sub. The tubular components can be made of NACE steel alloy or similar material and connects sealably the frachead body to the lower tubular structure with appropriate annular seals.

Upper seals are positioned between the bore of the frachead and the outside cylindrical surface of the outer sealing sub, such as in the annular interface therebetween. Lower seals are positioned between facing surfaces of the bore of the lower tubular structure and the outside cylindrical surface of the outer sealing sub, such as in the annular interface therebetween.

In a second embodiment, the tubular connector is a single component acting as both the inner tubular wear sleeve and the outer tubular sealing sub. The complete unitary or monolithic tubular connector can be made of NACE steel alloy or similar material and connects sealably the frachead body to the lower tubular structure with appropriate annular seals.

Flange interfaces, as found in prior art typically utilize a ring gasket between the facing flanges. Herein, the sealing across the flange interface, using the upper and lower sealing elements of the cylindrical sleeve creates high pressure seals and eliminates the need for an API standard ring gasket and allows the tubular connector to be manufactured to an outside diameter larger than if the API ring gasket were required. Further, provision for an intermediate lower tubular structure, such as a spool, enables larger bores than merely modifying a wellhead.

This invention makes it economical to refurbish the eroded parts and in addition there is no reliance on a single API ring gasket seal. An added advantage is that the seals associated with the cylindrical sleeve can be used many times as opposed to an API ring gasket which requires changing after only several connections.

DESCRIPTION OF THE EMBODIMENTS OF THE INVENTION

Figure 1A:
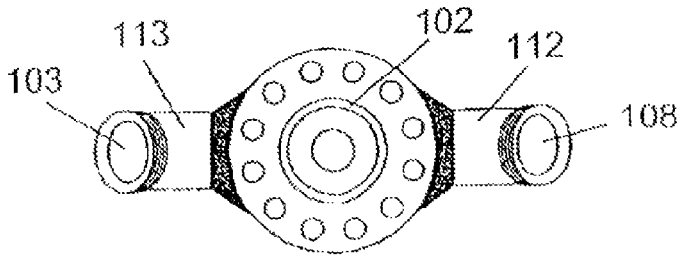
Fig. 1A Prior Art
FIGS. 1A and 1B illustrate top and side cross-sectional views of a prior art, three port frachead having a top entry, two side entries and a representation of fluid flow through a wear sleeve according to U.S. Pat. No. 6,899,172.
Figure 1B:
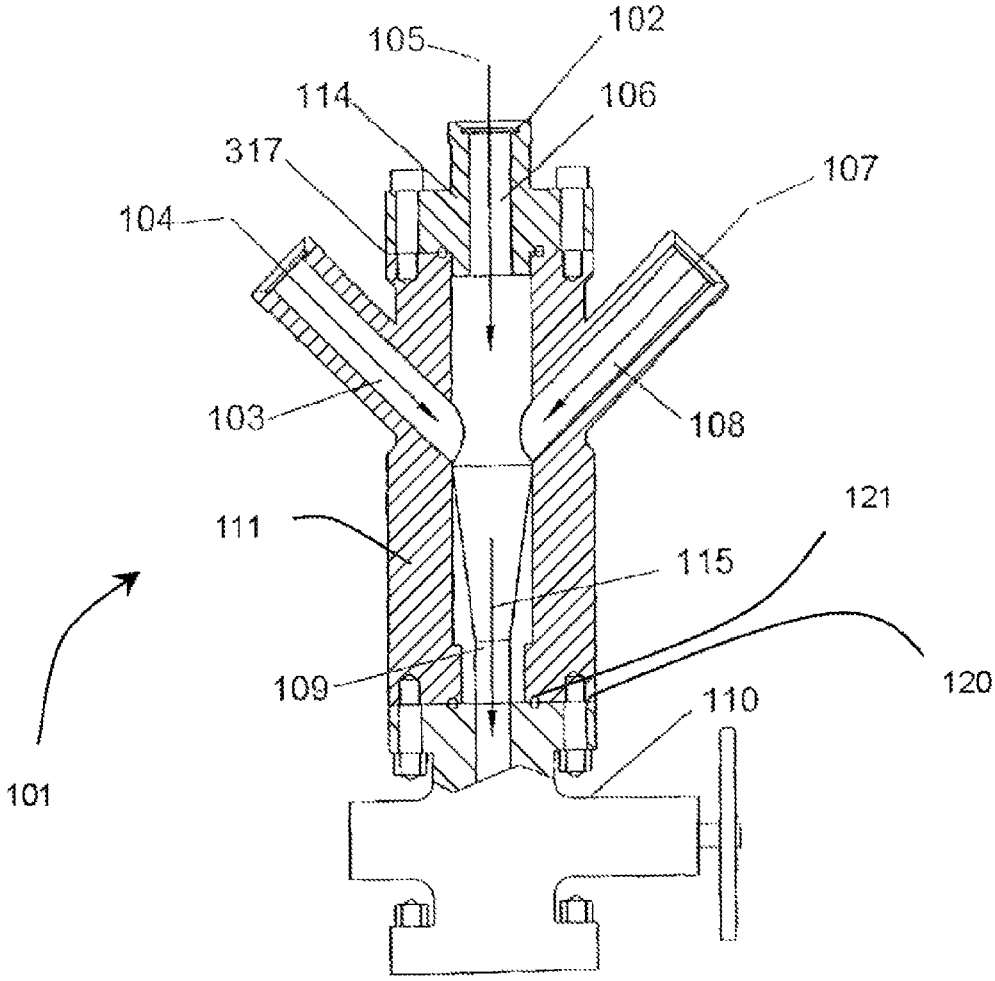
Fig. 1B Prior Art

FIGS. 1A and 1B illustrate a known frachead 101 or portion thereof. The frachead of the usual type used in the oil field practice of fracturing an oil or gas well. A frachead 101 can comprise a flow block or a combination of tubular structures including the flow block, valves and adapters suitable for connection to a wellhead. As shown, the frachead 101 is comprised of a main body 111, a cap 114, top entry 102, and side entries 113, 112. Motion of an abrasive fracturing fluid is shown as arrows 104, 105 and 107 and the combined flow 115 through bore 109. The frachead 101 is fit to a well head such as through a valve 110. This particular configuration is called a three port frachead. The prior art connection of frachead and valve is shown using a conventional API flanged interface 120 with a ring gasket 121 sandwiched therebetween for sealing the fracturing fluids within the bore 109.

With reference to FIGS. 2-7, embodiments of the invention comprise an improved seal and connection system for a frachead.

With reference to FIGS. 2-4A, a multi-purpose tubular connector 201 extends between a frachead body 202 and downstream tubular components leading to the wellhead. The downstream components, which could be the wellhead itself, comprise some intermediate lower tubular structure such as lower spool 203. The tubular connector 201 bridges a flange interface 209 between a lower interface 206 of the frachead 202 and an upper interface 205 of the lower spool 203 for forming a contiguous bore 204 for fluid communication of fracturing fluids from the frachead body 202 to the lower tubular structure and wellhead.

The upper interface 205 of the lower spool 203 has a flange 222. The frachead body 202 comprises a main bore 204*a* having an axis which is concentrically aligned with an axis of a lower bore 204*b* of the lower spool 203 for connection thereto. The frachead body 202 connects to the flange 222 of the lower spool 203 either through a mating flange using stud fasteners (FIG. 4A) or a bolted connection (not shown). The tubular connector 201 comprises a tubular sleeve having a connector bore 204*c*. The tubular connector 201 is secured in the main internal bore 204*a* of the frachead body 202 downstream of side entries 210. Two or more side entries 210 can be arranged circumferentially about the main body 202 and typically opposing each other.

The main bore 204*a* of the frachead body 202 is sized or enlarged to accept a first upper end 223 of the tubular connector 201. The bore 204*b* of the lower spool 203 is modified, such as in the case of an existing structure or wellhead, or is otherwise manufactured to accept a second lower end 224 of the tubular connector 201. The tubular connector 201 forms a contiguous bore 204 from the main bore 204*a* of the frachead body 202, through the connector bore 204*c*, and to the lower bore 204*b* of the lower spool 203, bridging the flange interface 209. The lower bore 204*b* of the lower spool 203 can be maximized by elimination of the conventional API ring gasket while retaining sufficient structure of the lower spool 203 for the required pressure service.

Figure 2:
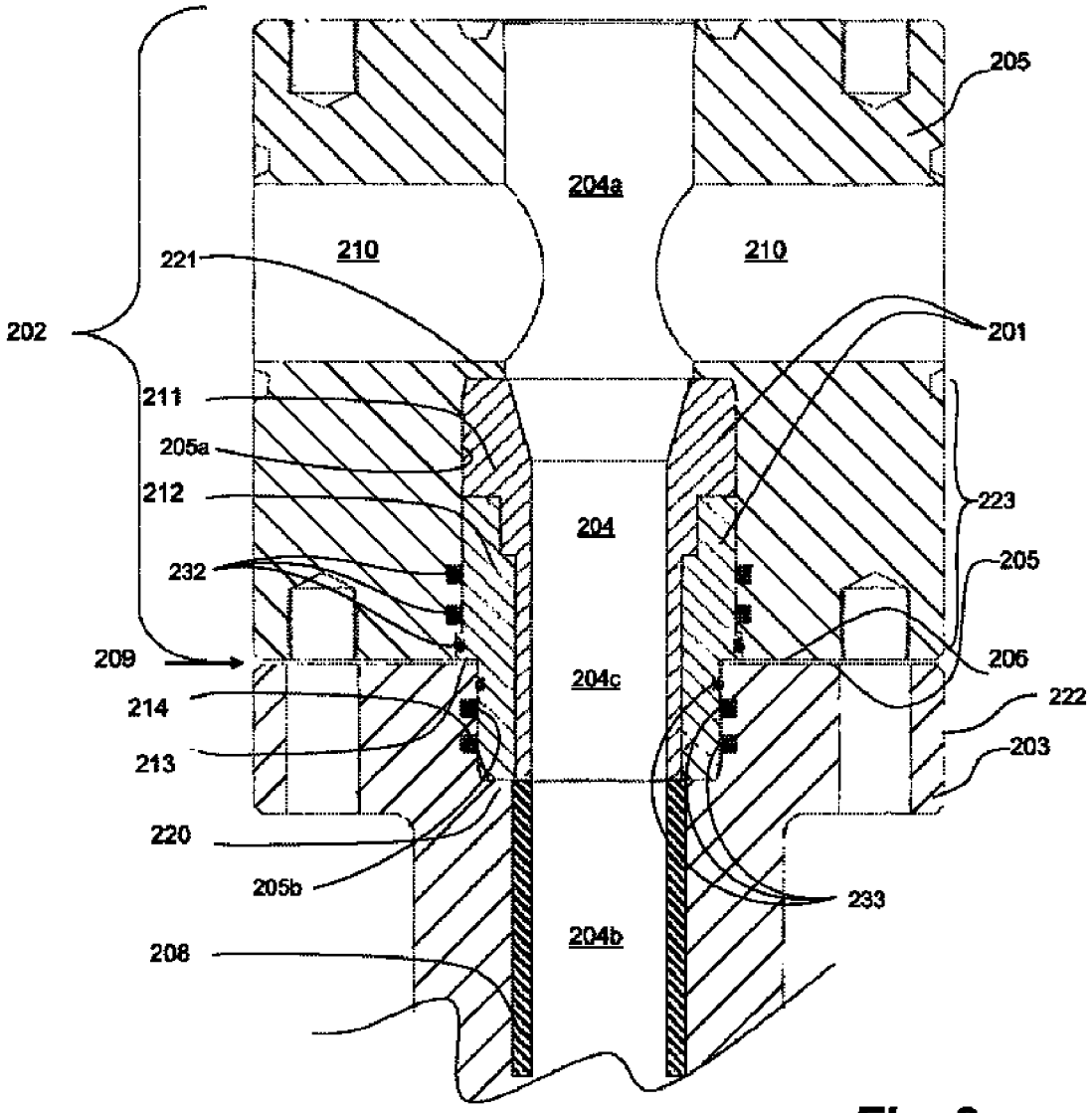
FIG. 2 is a side cross-sectional view of the connecting flange interface of an upper frachead and a lower tubular structure illustrating one embodiment of a two-piece tubular connector bridging the flange interface.
Figure 3:
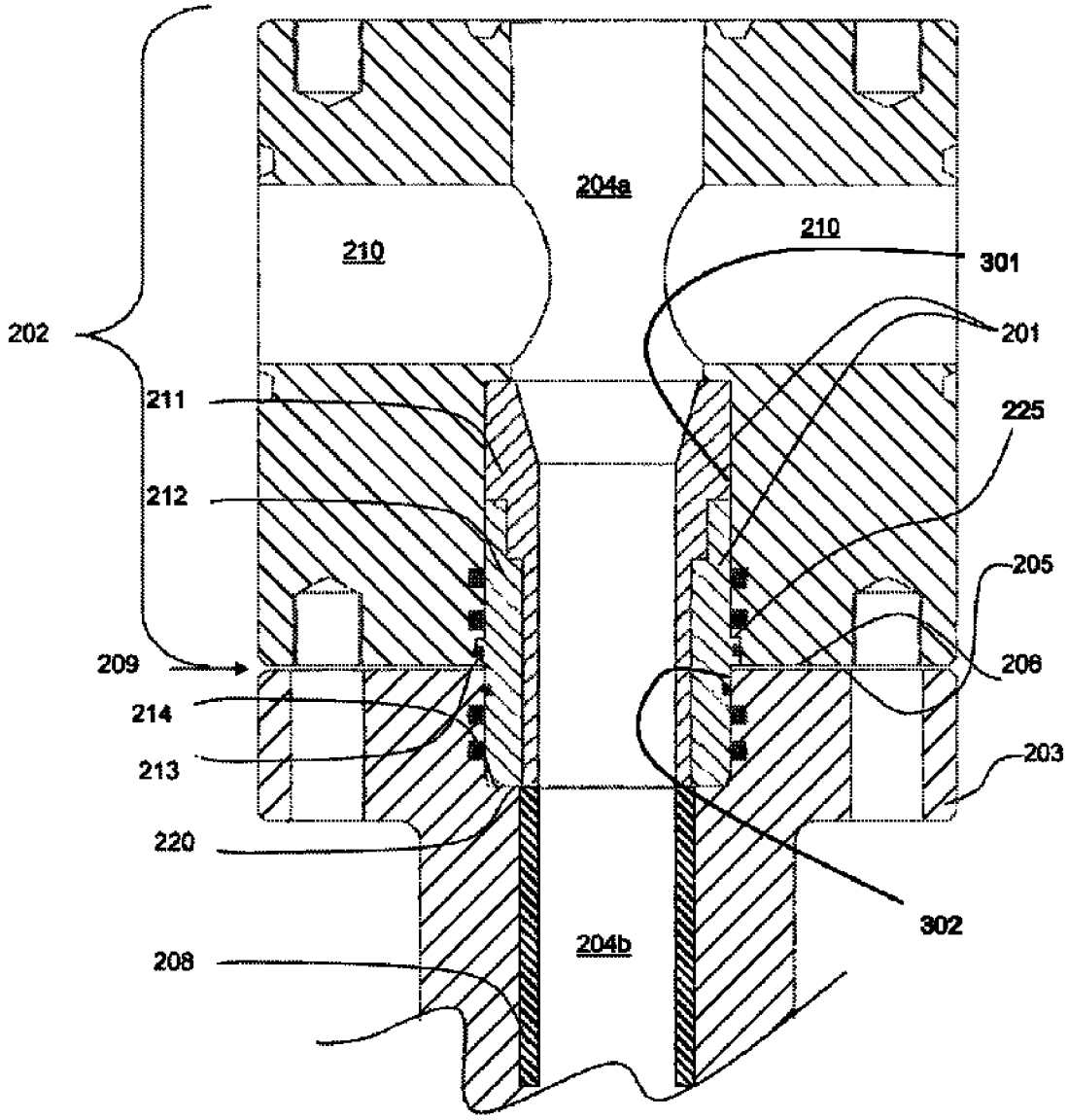
FIG. 3 is a side cross-sectional view of another embodiment of a tubular connector.

The outer diameter of the upper end 223 can be different that the outer diameter of the lower end 224. As shown in FIG. 2, the diameter of the upper end 223 is greater than the diameter of the lower end 224. Or the diameter of the lower end 224 can be greater than the diameter of the upper end 223 (not shown).

Absent a conventional API ring gasket, the bore 204, for conducting high pressure fracturing fluids, is now separated from the environment at the flange interface 209 by the tubular connector 201. Accordingly, the tubular connector 201 is provided with at least an upper seal of one or more upper sealing elements 232 above the flange interface 209 and at least a lower seal of one or more lower sealing elements 233 below the flange interface 209.

Figure 4A:
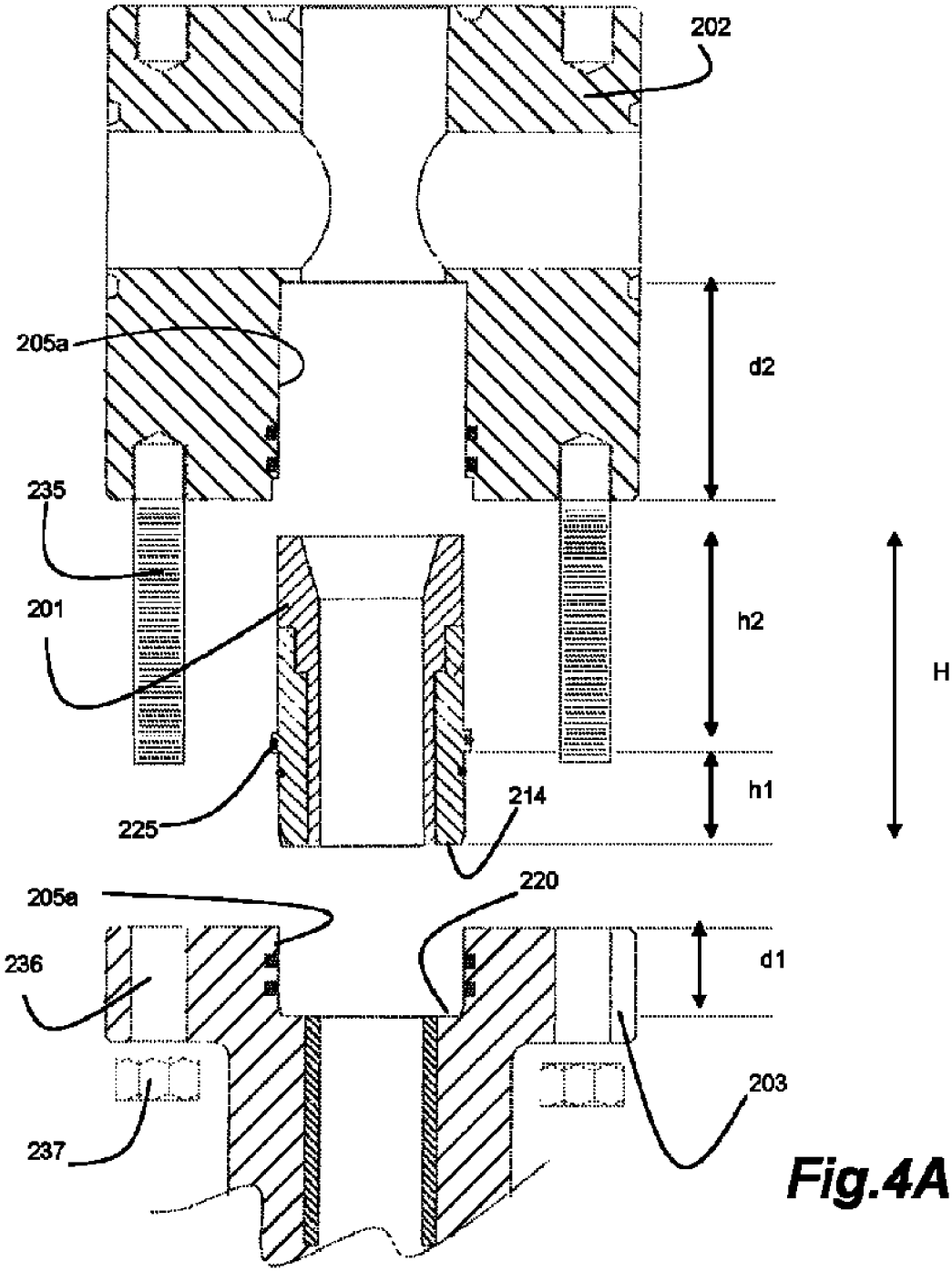
FIG. 4A is an exploded view of the system of FIG. 3.
Figure 4B:
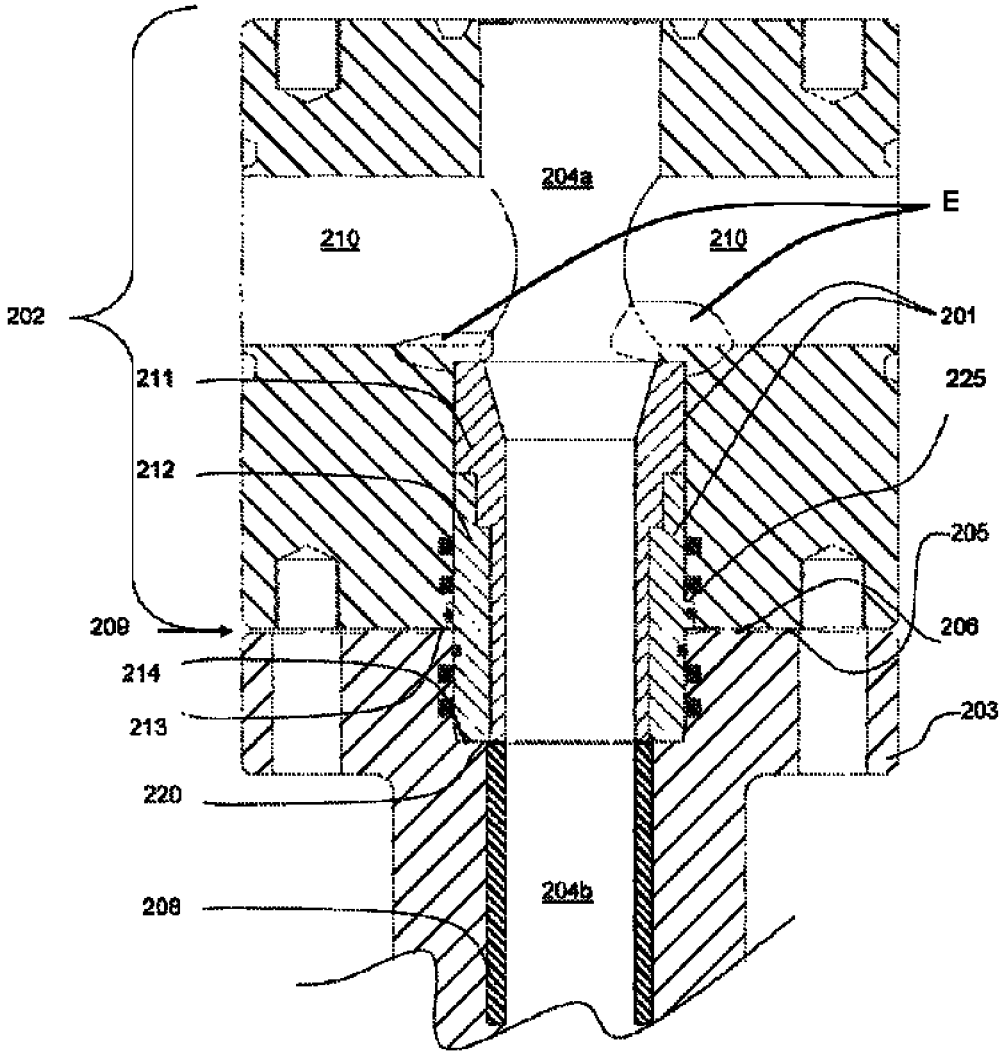
FIG. 4B is the system of FIG. 3, illustrating hypothetical erosion of the frachead.
Figure 5B:
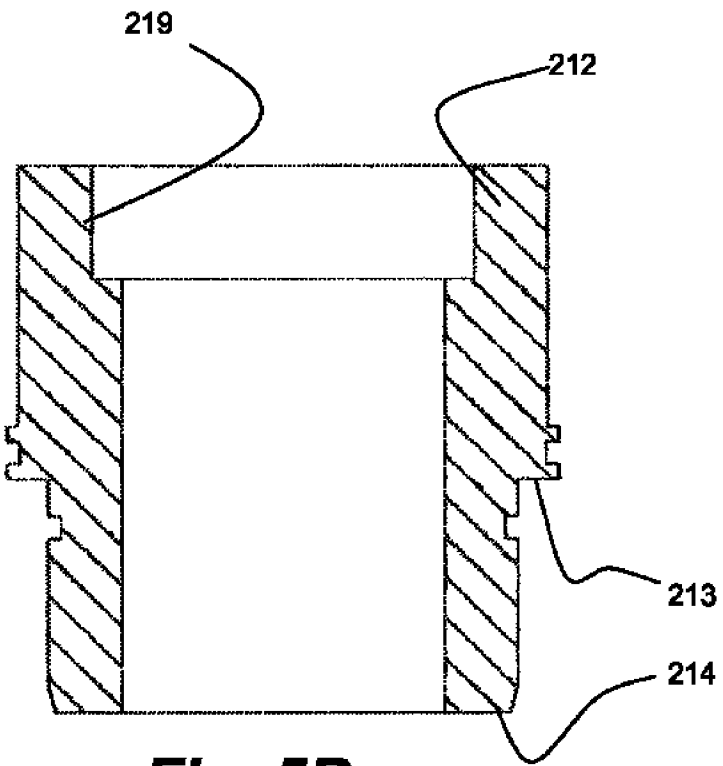
FIGS. 5A and 5B are cross-sectional views of the wear sleeve according to FIG. 2.
Figure 5A:
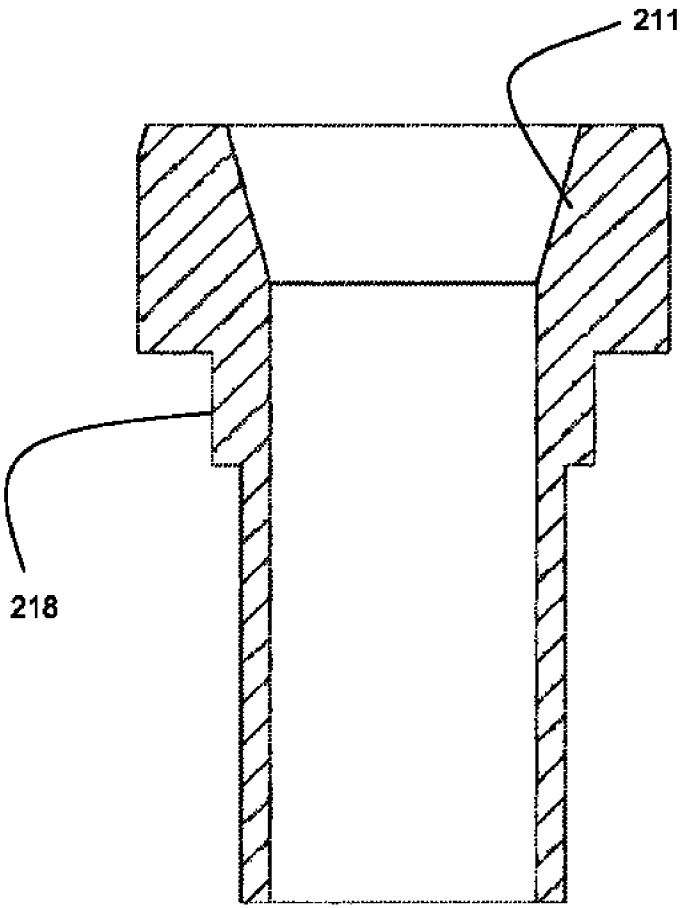
Figure 6B:
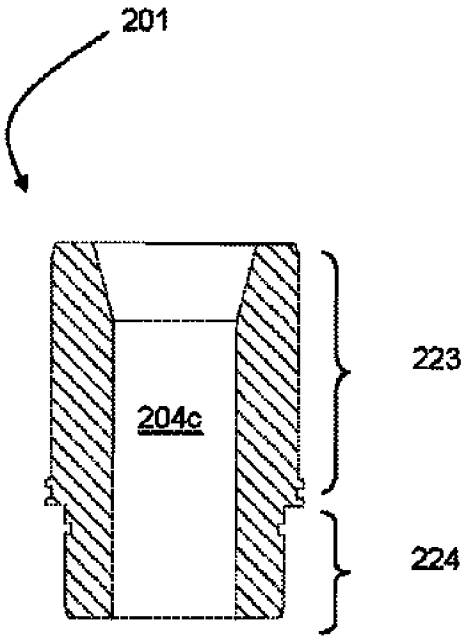
FIG. 6B is a side cross-sectional view of the wear sleeve according to FIG. 6A.
Figure 6A:
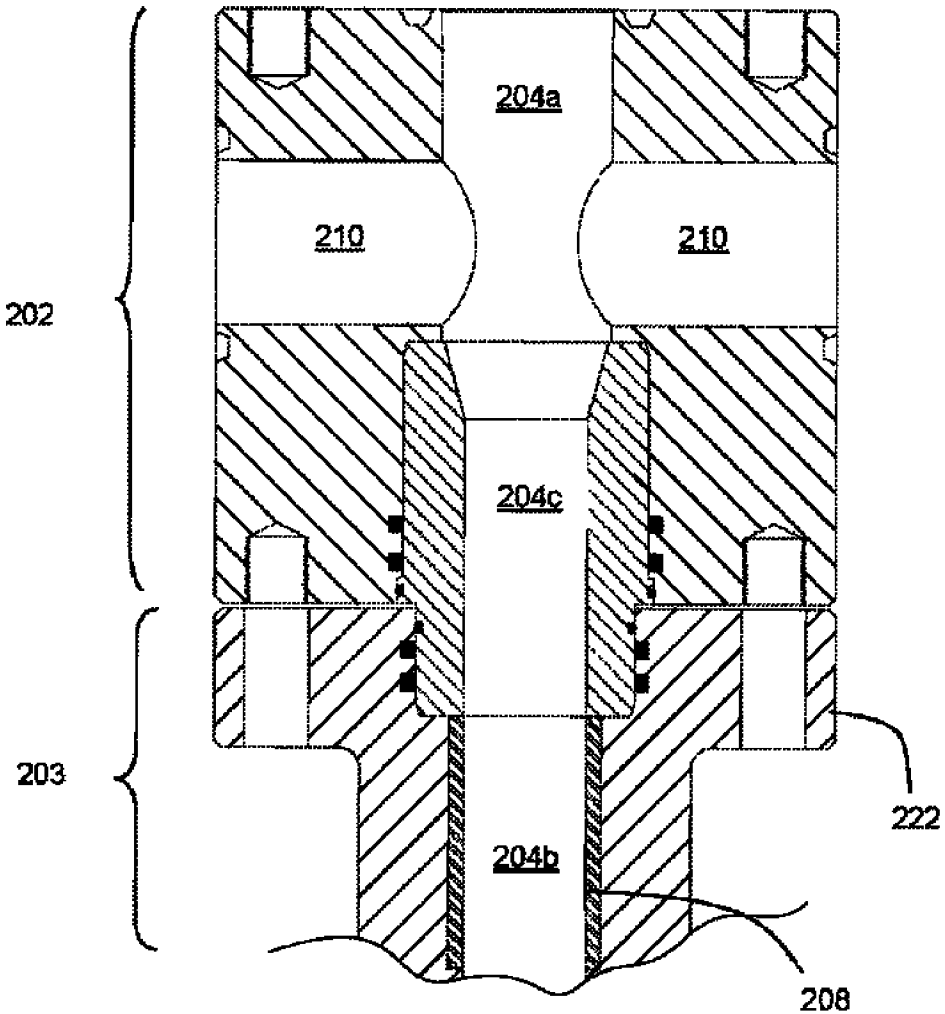
FIG. 6A is a side cross-sectional view of the connecting flange interface of an upper frachead and a lower tubular structure illustrating another embodiment of a monolithic wear sleeve bridging the flange interface.
Figure 7:
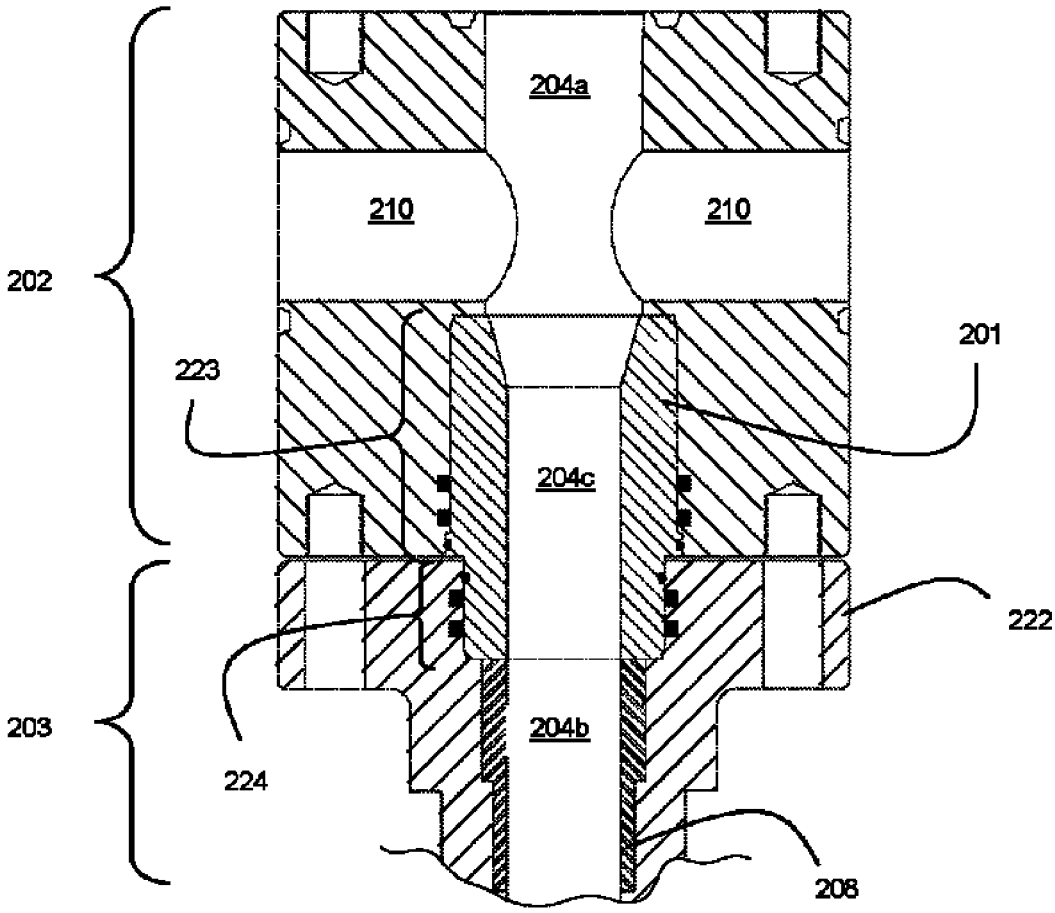
FIG. 7 is a side cross-sectional view of the connecting flange interface according to FIG. 6A and having an optional downstream wear sleeve.

According to an aspect of the invention, the tubular connector 201 can be an monolithic abrasion-resistant structure or wear sleeve shown in FIGS. 6A,6B and 7, or in another embodiment, can be a two-part assembly shown in FIGS. 2 to 5B.

In a two-part embodiment of FIGS. 2 to 5B, the tubular connector 201 can comprise a tubular, inner wear sleeve 211 fit co-axially to a tubular, outer sealing sub 212. The inner wear sleeve 211 forms the wear-resistant and contiguous bore 204 from the frachead 202 to the lower spool 203. The inner wear sleeve 211 comprises wear-resistant material.

The wear sleeve can be secured within the outer sealing sub such as by mechanical or adhesive means. For example, Locktite® can be used between the components to ensure the inner wear sleeve 211 is retained within the sealing sub 212.

As shown in FIGS. 5A and 5B, in one embodiment of the two-part assembly, an outer diametral extent 218 of the inner wear sleeve 211 is stepped for inserting and mating concentrically with a stepped inner diametral extent 219 of the outer sealing sub 212. The outer sealing sub 212 has an axial height less than that of the inner wear sleeve wherein the connector bore is formed entirely of the wear sleeve 211. The outer diameter of an upper end of the inner wear sleeve 211 can be the same diameter as that of an upper end of the outer sealing sub 212.

An upper sleeve bore 205*a* of the frachead body 202 is sized to accept the inner wear sleeve 211 and the outer sealing sub 212 of the tubular connector 201. A lower sleeve bore 205*b* of the lower tubular structure 203 is manufactured or enlarged to accept the outer sealing sub 212 of the tubular connector 201. Accordingly, the wear sleeve 211 forms the contiguous bore 204 bridging between the main bore 204*a* of the frachead body 202 and the lower bore 204*b* of the lower spool 203. Preferably, as shown in FIG. 4A, the axial depth d1 of the sleeve bore 205*b* is less than an axial extent of the flange 222 for maximizing the structural material of the lower tubular structure 203.

The frachead body 202 can have a flange (not shown) or, as shown in FIGS. 2, 3, 4A, 4B and 6A the lower tubular structure has an upper interface 205 adapted for connection at the flange interface 209 to a lower interface 206 of compatible connector or flange 222 of the lower spool 203 using stud and nut fasteners. The fastener studs 235 extend from the frachead body to pass through bolt holes 236 in the lower spool for securing with nuts 237.

For protecting against abrasive wear on the pressure retaining bore 204, the wear-resistance wear-sleeve portion of the tubular connector 201 may be made of EN30B high strength steel available from British Steel Alloys, other suitable abrasion resistant steel such as Astrally™, or lined with an even more erosion resisting coating such as tungsten carbide or similar material. The materials of construction for the frachead body 202 can thus be selected for ease of fabrication, chemical resistance, and for welding compatibility. This leads to lower initial costs for the frachead, easy visual checking of attrition in a field repair of a worn frachead tubular connector 201, and greater reliability of the frachead in service.

With reference to FIG. 4A the tubular connector 201 has an axial height H. The axial height H is defined as the sum of the axial height h1, from a bottom 214 of the tubular connector 201 to a bottom 213 of a retaining shoulder 225 and h2, from a top of the tubular connector 201 to the bottom 213 of the shoulder 225. The main bore 204*a* of the frachead 202 has an axial depth d2 and the lower sleeve bore 204*b* has an axial depth d1.

Upon assembly, and tightening of the flange interface, the bottom 214 of the tubular connector 201 fully engages the lower tubular structure 203. The upper frachead body 202 engages the shoulder 225 to drive the tubular connector 201 and its bottom 214 to fully engage the lower terminating shoulder 220 of the lower tubular structure 203. Accordingly, there will be a gap formed at the flange interface 209 as shown in the figures.

The axial height h1 of the lower end 224 of the tubular connector 201 is greater than the axial depth d1 of the lower bore 204*b* of the lower tubular structure 203 to ensure that the bottom 214 of the tubular connector 201 fully engages the lower terminating shoulder 220 minimizing any opportunities for wear of the lower tubular structure 203.

The axial height H is preferably greater than the sum of the axial depth d1, d2 of the bores 204*a*, 204*b* to prevent movement of the tubular connector 201 when the system is fully assembled.

The tubular connector 201 can be sandwiched between an upper terminating shoulder 221 offset upwardly from the flange interface 209 in the frachead body 202 and a lower terminating shoulder 220 in the load spool 203 respectively.

Note that in the case of a tubular connector 201 having a larger outer diameter lower end 224 the retaining shoulder 225 is formed by the diametric change.

As shown, the retaining shoulder 225 can have a first shoulder 213 terminating at the flange interface 209. The bottom 214 of the tubular connector 201 abuts against the lower terminating shoulder 220 offset downwardly from flange interface 209.

The connector bore 204*c* may be tapered in the direction of the flow of the abrasive fluids.

The tubular connector 201 bridges across the flange interface 209.

The main bore 204*a*, lower bore 204*b*, and connector bore 204*c* are sealed from the flange interface 209 by upper sealing elements 232 such as in a first annulus 301 between the tubular connector 201 and the sleeve bore 205*a* of the frachead body 202. Similarly, the lower sealing elements 233 can be positioned in a second annulus 302 between the tubular connector 201 and the sleeve bore 205*b* of the lower spool 203. The sealing elements 232, 233 enable ease of repair and replacement of the system components. Unlike the deformable ring gaskets of the prior art, the sealing elements 232, 233 are capable of repeated disassembly and reassembly before replacement.

As shown in FIGS. 2-7, each of the upper and lower sealing elements 232, 233 can be formed of two or more commercially available annular seals or combinations of commercially available annular seals and O-rings.

In one embodiment the retaining shoulder 225 is located between the upper and lower sealing elements, 232, 233, at the flange interface 209, and ensures the correct positioning of the tubular connector 201 in the overall system and retention therein.

As shown in FIG. 4B, over time and with use, the terminating shoulder 221 of the frachead body 202 is exposed to the erosive conditions of the abrasive fluids, will eventually erode E, and will no longer be able to transfer any downward force from the frachead 202 to the tubular connector 201. At such time, all the downward retaining forces applied by the frachead 202 to the tubular connector 201 would be transferred by the retaining shoulder 225.

The retaining shoulder 225 further prevents any upward movement of the tubular connector 201 in the event that there is a reverse in the direction of the abrasive fluids.

Preferably the retaining shoulder 225 is an annular shoulder. More preferably, the annular grooves for an O-ring are formed in the retaining shoulder 225, as part of the upper sealing elements 232.

Initially, the frachead body 202 applies a downward retaining force onto the terminating shoulder 221 and the retaining shoulder 225. This downward retaining force is transferred to the tubular connector 201 to force the tubular connector 201 to abut tightly against the terminating shoulder 220 of the lower tubular structure 203.

The retaining shoulder 225 need not necessarily be placed between the upper and lower sealing elements 232, 233. The retaining shoulder 225 may be located along the outer annular surface of the upper portion 223 of the tubular connector 201 but is spaced sufficiently away from the terminating shoulder 221 such that the retaining shoulder 225 is not affected by the erosive conditions of the abrasive fluids.

Typically, there is greater flexibility to modify the frachead body 202 for accommodating either a larger diameter or upset of the tubular connector, or for sealing elements 232, 233. As shown in FIGS. 2 and 7, the annular seals 232, 233 can reside in annular grooves formed in the frachead body 202 and the thicker flange 222 area of the lower spool 203 while the O-rings are can be supported in annular grooves formed in the tubular connector 201.

Using two or more annular sealing elements 232, 233 enables backup seals and permits the use of seals having two or more differing material properties wherein one of the materials is more likely found to be suitable for the fluid environment.

As shown in FIGS. 2 and 6A, the lower spool 203 can also be fitted with an optional downstream wear sleeve 208.

A person skilled in the art could make immaterial modifications including modifications to areas such as the seal ring positions in the invention disclosed without departing from the invention.

The embodiments of the invention for which an exclusive property or privilege is claimed are defined as follows:

1. A wear-resistant sealing system for introducing fracturing fluids to a wellhead comprising:

a lower tubular structure having an axially extending and lower bore in fluid communication with the wellhead, the lower bore terminating at a lower terminating shoulder;

a frachead for fluidly connecting to the lower tubular structure forming an interface therebetween, the frachead having one or more fluid ports in communication with an axially extending main bore;

a wear-resistant tubular connector having a bottom, the tubular connector fit to the main bore and fit to the lower bore, the tubular connector extending from the main bore of the frachead into the lower bore of the lower tubular structure for forming an axially extending, contiguous bore bridging across the interface, for fluid communication of fracturing fluids from the frachead to the lower tubular structure and wellhead;

at least an upper seal in a first annulus formed between the tubular connector and the frachead for sealing the first annulus from the interface; and at least a lower seal in a second annulus formed between the tubular connector and the lower tubular structure for sealing the second annulus from the interface;

wherein the frachead engages the tubular connector to drive the bottom of the tubular connector to fully engage the lower terminating shoulder of the lower tubular structure for protecting both the main bore and the lower bore; and wherein the at least an upper seal and the at least a lower seal isolate the interface from the fracturing fluids.

2. The system of claim 1 wherein the tubular connector further comprises a retaining shoulder positioned intermediately along the tubular connector for engaging the frachead and retaining the .tubular connector within the lower bore.

3. The system of claim 2 wherein the tubular connector has a lower end below the retaining shoulder, having a first height, and the lower tubular structure has a lower bore having a first depth wherein the first height of the tubular connector is greater than the first depth of the lower bore.

4. The system of claim 1 wherein the tubular connector is monolithic wear-resistant material.

5. The system of claim 1 wherein the tubular connector further comprises a inner wear sleeve of wear-resistant material and an outer sealing sub wherein the at least an upper seal and at least a lower seal are between the outer sealing sub and the frachead and lower tubular structure respectively.

6. The system of claim 1 wherein:

the tubular connector has a connector height;

the lower bore forms a lower connector bore having a lower shoulder offset downwardly a first depth from the interface;

the main bore forms an upper connector bore having an upper shoulder offset upwardly a second depth from the interface; and wherein the connector height is greater than the sum of the first and second depths so that when the frachead is axially connected to the lower tubular structure, a gap is formed between in the interface.

7. The system of claim 1 wherein the at least an upper seal is two or more upper sealing elements.

8. The system of claim 7 wherein two or more upper sealing elements have at least two differing material properties.

9. The system of claim 1 wherein the main bore of the frachead further comprises one or more annular grooves for receiving the at least an upper seal.

10. The system of claim 9 wherein the at least an upper seal includes an O-ring; and the tubular connector further comprises at least one annular groove for receiving the O-ring.

11. The system of claim 1 wherein the at least a lower seal is two or more lower sealing elements.

12. The system of claim 11 wherein two or more lower sealing elements have at least two differing material properties.

13. The system of claim 1 wherein the lower bore of the lower tubular structure further comprises one or more annular grooves for receiving the at least a lower seal.

14. The system of claim 13 wherein:

the at least a lower seal includes an O-ring; and the tubular connector further comprises at least one annular groove for receiving the O-ring.

15. The system of claim 1 wherein an outer diameter of an upper end of the tubular connector is greater than an outer diameter of a lower end of the tubular connector.

16. The system of claim 1, wherein the tubular connector further comprises a retaining shoulder positioned intermediately along the tubular connector, wherein the frachead engages the retaining shoulder for driving the bottom of the tubular connector.

17. The system of claim 1, wherein the frachead further comprises an upper terminating shoulder for engaging the tubular connector and driving the bottom of the tubular connector.

18. The system of claim 1 wherein the tubular connector has an axial height that is greater than a combined depth of an axial depth of the main bore and an axial depth of the lower bore for creating a gap at the interface.

19. Apparatus for sealing an interface between a frachead and a wellhead structure, the frachead having a main bore in fluid communication and co-axial with a lower bore having a lower terminating shoulder of the wellhead structure, the apparatus comprising:

a wear-resistant tubular connector having a bottom, the tubular connector adapted to fit to the main bore and adapted to fit to the lower bore, the tubular connector extending from the main bore of the frachead to the lower bore to axially bridge an interface between the bore of the frachead and the bore of the wellhead structure, forming a contiguous bore for fluid communication of the fracturing fluids from the frachead to the wellhead structure when the frachead is connected axially to the wellheadl structure at the interface;

at least an upper seal in a first annulus between the tubular connector and the frachead for sealing the first annulus from the interface; and at least a lower seal in a second annulus between the tubular connector and the wellhead structure for sealing the second annulus from the interface, wherein the frachead engages the tubular connector to drive the bottom to fully engage the lower terminating shoulder of the wellhead structure.

20. The apparatus of claim 19 wherein the tubular connector further comprises a retaining shoulder positioned intermediately along the tubular connector for engaging the frachead and retaining the tubular connector within the lower bore.

21. The apparatus of claim 19 wherein the tubular connector has a lower end below the retaining shoulder, having a first height, and the lower tubular structure has a lower bore having a first depth wherein the first height of the tubular connector is greater than the first depth of the lower bore.

22. The apparatus of claim 19 wherein the tubular connector is monolithic.

23. The apparatus of claim 19 wherein the tubular connector is of wear-resistant material.

24. The apparatus of claim 19 wherein the tubular connector further comprises a inner wear sleeve of wear-resistant material fit co-axially to an outer sealing sleeve wherein the at least an upper seal and at least a lower seal are between the outer sealing sub and the frachead and lower tubular structure respectively.

25. The apparatus of claim 19 wherein the at least an upper seal is two or more upper sealing elements.

26. The apparatus of claim 25 wherein two or more upper sealing elements have at least two differing material properties.

27. The apparatus of claim 26 wherein:

the at least an upper seal includes an O-ring; and the tubular connector further comprises at least one annular grooves for receiving the O-ring.

28. The apparatus of claim 19 wherein the at least a lower seal is two or more lower sealing elements.

29. The apparatus of claim 28 wherein two or more lower sealing elements have at least two differing material properties.

30. The apparatus of claim 29 wherein:

the at least a lower seal includes an O-ring; and the tubular connector further comprises at least one annular grooves for receiving the O-ring.

31. A sleeve for protecting a frac block secured to a lower tubular structure from pressurized fluids containing abrasive materials, the frac block and lower tubular structure forming an interface therebetween, the wear sleeve comprising:

a replaceable abrasion resistant cylindrical sleeve, adapted on a first end to fit in a bore of the frac block and adapted on a second end to fit in a bore of the lower tubular structure, for providing a contiguous sleeve bore extending from the bore of the frac block, bridging the interface between the bore of the frac block and the bore of the lower tubular structure, and into the lower tubular structure, the cylindrical sleeve further comprising:

an internal sleeve bore, the sleeve bore comprising a first open end in fluid communication with the bore of the frac block, a second open end in fluid communication with the bore of the lower tubular structure, and a retaining shoulder positioned intermediately along the tubular connector for engaging the frac block and retaining the tubular connector within the lower bore;

upper annular sealing elements positioned in a first annulus between an outer cylindrical surface of the cylindrical sleeve and the bore of the frac block; and lower annular sealing elements positioned in a second annulus between an outer cylindrical surface of the cylindrical sleeve and the lower tubular structure, wherein when the frac block is secured to the lower tubular structure, the upper and lower annular sealing elements isolate the interface from the pressurized fluids, and the cylindrical sleeve is driven to fully engage the lower tubular structure to form a gap at the interface.

32. The sleeve of claim 31 wherein an outer diameter of the first end of the cylindrical sleeve is the same as an outer diameter of the second end of the cylindrical sleeve.

33. The sleeve of claim 31 wherein an outer diameter of the first end of the cylindrical sleeve is greater than an outer diameter of the second end of the cylindrical sleeve.

34. The sleeve of claim 31 further comprising an inner abrasion-resistant cylindrical wear sleeve and a cylindrical sealing sub wherein the inner wear sleeve further comprises an upper upset portion adapted to sit on top of the cylindrical sealing sub, and a lower sleeve portion adapted to fit inside the cylindrical sealing sub, the lower sleeve portion providing a unitary contiguous sleeve bore that bridges the interface between the frac block and lower tubular structure;

the upper sealing elements are positioned between the outer cylindrical surface of the cylindrical sealing sub and the bore of the frac block; and the lower sealing elements are positioned between the outer cylindrical surface of the cylindrical sealing sub and the lower tubular structure.

35. The wear sleeve of claim 31 wherein the upper and lower sealing elements are high pressure sealing elements.

36. The wear sleeve of claim 31 wherein the upper sealing elements further comprise a first sealing element of a first composition, a second sealing element of a second different composition and a third sealing element further comprising an O-ring.

37. The wear sleeve of claim 31 wherein the lower sealing elements further comprise a first sealing element of a first composition, a second sealing element of a second different composition and a third sealing element further comprising an O-ring.

* * * * *